US010697051B2

(12) United States Patent
Kim et al.

(10) Patent No.: US 10,697,051 B2
(45) Date of Patent: Jun. 30, 2020

(54) METHOD FOR MANUFACTURING ALLOY 690 ORDERED ALLOY WITH IMPROVED THERMAL CONDUCTIVITY, AND ALLOY 690 ORDERED ALLOY MANUFACTURED THEREBY

(71) Applicant: Korea Atomic Energy Research Institute, Daejeon (KR)

(72) Inventors: Young-Suk Kim, Daejeon (KR); Sung-Soo Kim, Daejeon (KR); Dae-Whan Kim, Daejeon (KR)

(73) Assignee: Korea Atomic Energy Research Institute, Daejeon (KR)

( * ) Notice: Subject to any disclaimer, the term of this patent is extended or adjusted under 35 U.S.C. 154(b) by 0 days.

(21) Appl. No.: 15/532,768

(22) PCT Filed: Dec. 3, 2015

(86) PCT No.: PCT/KR2015/013172
§ 371 (c)(1),
(2) Date: Jun. 5, 2017

(87) PCT Pub. No.: WO2016/089145
PCT Pub. Date: Jun. 9, 2016

(65) Prior Publication Data

US 2017/0327934 A1 Nov. 16, 2017

(30) Foreign Application Priority Data

Dec. 5, 2014 (KR) ..... 10-2014-0174299

(51) Int. Cl.

| | |
|---|---|
| ***C22F 1/10*** | (2006.01) |
| ***C22C 19/05*** | (2006.01) |
| ***C21D 1/26*** | (2006.01) |

(52) U.S. Cl.
CPC ..... *C22F 1/10* (2013.01); *C21D 1/26* (2013.01); *C22C 19/05* (2013.01); *C22C 19/058* (2013.01)

(58) Field of Classification Search
CPC ..... C22F 1/10; C22C 19/05; C22C 19/058; C21D 1/26
(Continued)

(56) References Cited

U.S. PATENT DOCUMENTS 4,710,237 A 12/1987 Yonezawa et al.

FOREIGN PATENT DOCUMENTS

JP 2005-525470 A 8/2005
KR 10-0250810 B1 4/2000
(Continued)

OTHER PUBLICATIONS

English language machine translation of KR 10-2011-0105156. Generated Mar. 18, 2010. (Year: 2010).*
(Continued)

*Primary Examiner* — Brian D Walck
(74) *Attorney, Agent, or Firm* — Reinhart Boerner Van Deuren P.C.

(57) ABSTRACT

The present invention relates to a method for manufacturing Alloy 690 ordered alloy to be used in a steam generator tube serving as a heat exchanger in a nuclear power plant (hereinafter, referred to as NPP), and Alloy 690 ordered alloy manufactured thereby, and provides a method for manufacturing Alloy 690 ordered alloy with improved thermal conductivity, and Alloy 690 ordered alloy manufactured thereby, the method comprising the steps of: solution-annealing Alloy 690; cooling the solution-annealed Alloy 690 to a first temperature of 200° C./min or less; and ordering the cooled Alloy 690 in the temperature range of 410-520° C.

8 Claims, 8 Drawing Sheets

(58) Field of Classification Search
USPC ..... 148/675
See application file for complete search history.

(56) References Cited

FOREIGN PATENT DOCUMENTS

| | | | |
|---|---|---|---|
| KR | 10-2010-0104928 | A | 9/2010 |
| KR | 10-2011-0105156 | A | 9/2011 |
| KR | 10-2012-0093336 | A | 8/2012 |

OTHER PUBLICATIONS

English language machine translation of KR 10-2010-0104928. Generated Nov. 30, 2015. (Year: 2015).*

* cited by examiner

METHOD FOR MANUFACTURING ALLOY 690 ORDERED ALLOY WITH IMPROVED THERMAL CONDUCTIVITY, AND ALLOY 690 ORDERED ALLOY MANUFACTURED THEREBY

TECHNICAL FIELD

The present invention relates to a method of manufacturing ordered Alloy 690 to be used as steam generator tubes which function as a heat exchanger in nuclear power plants (hereinafter referred to as NPPs), and ordered Alloy 690 manufactured thereby.

BACKGROUND ART

A steam generator tube of a nuclear power plant (hereinafter referred to as NPP) is a heat exchanger which transfers heat from a primary coolant loop to a secondary one to produce steam in the latter. At the early stage of nuclear industry, Alloy 600 was mainly used in steam generator tubes, but as plant operation times increased, Alloy 600 came to be known for its high susceptibility to primary water stress corrosion cracking (PWSCC).

To solve this problem, Alloy 690 containing a higher content of Cr than Alloy 600 has recently been used as steam generator tubes instead of Alloy 600 due to its higher resistance to PWSCC.

Alloy 600 is a Ni-based alloy with a composition, in weight percent, of 14-17% Cr, 6-10% Fe, 0.15% C max., 1% Mn max., 0.5% Si max., and 0.015% S max., and Alloy 690 is a Ni-base alloy with a composition, in weight percent, of 27-31% Cr, 7-11% Fe, 0.05% C max., 0.5% Mn max., 0.5% Si max., 0.5% Cu max., and 0.015% S max.

As described above, Alloy 690 is a material with a higher Cr concentration than Alloy 600, and was originally called "Inconel Alloy 690" after the name of its developer, or Inco Alloys International. Inc., but is now called "Alloy 690" since their patent has expired.

Since Alloy 690 has a lower thermal conductivity than Alloy 600 by 11%, a replaced steam generator made of Alloy 690 should contain a higher number of Alloy 690 tubes by 11%, or about 2,000 more, to compensate the loss of thermal heat transfer caused by a lower thermal conductivity of Alloy 690, leading to an increase in the size and manufacturing cost of a steam generator tube of Alloy 690.

PRIOR-ART DOCUMENT (Patent Document 1) U.S. Pat. No. 4,710,237

DISCLOSURE

Technical Problem

Based on the experimental observations that pure metals with a high degree of order have very high thermal conductivity whereas metallic alloys with a low degree of order have low thermal conductivity, the present invention is directed to providing a method of overcoming the weakness of Alloy 690 which has high PWSCC resistance but low thermal conductivity.

In other words, by increasing the degree of order in Alloy 690 through an ordering treatment, the present invention is directed to providing ordered Alloy 690 with improved thermal conductivity.

In addition, the present invention is directed to providing a method of manufacturing ordered Alloy 690 with improved thermal conductivity by increasing the ordering rate.

Technical Solution

To achieve these objects, the present invention provides a method of manufacturing ordered Alloy 690 with improved thermal conductivity, which includes solution-annealing Alloy 690; cooling the solution-annealed Alloy 690 to a first temperature at a rate of 200° C./min or less; and ordering the cooled Alloy 690 by annealing in a temperature range of 410-520° C.

In addition, the present invention provides ordered Alloy 690 with improved thermal conductivity manufactured by the above-described manufacturing method.

Advantageous Effects

According to the present invention, by solution-annealing Alloy 690, cooling to or below an ordering temperature at a rate of 200° C./min or less without water quenching and thermal treatment (TT), and then ordering by annealing in a temperature range of 410-520° C., ordered Alloy 690 with improved thermal conductivity as compared to before the ordering treatment can be manufactured.

In addition, according to the present invention, by solution-annealing Alloy 690 and then ordering on the way to cooling at a rate of 200° C./min or less without water quenching and thermal treatment (TT), in the manufacture of ordered Alloy 690 with improved thermal conductivity, the manufacturing process thereof is shortened and its efficiency is improved.

Additionally, since ordered Alloy 690 with improved thermal conductivity leads to an increase in heat-transfer efficiency when used as a steam generator tube, the thermal efficiency of a nuclear power plant increases, or the number of steam generator tubes decreases, thus reducing the size of the steam generator.

MODES OF THE INVENTION

Hereinafter, exemplary embodiments of a method of manufacturing ordered Alloy 690 with improved thermal conductivity and ordered Alloy 690 manufactured thereby according to the present invention will be described in detail with reference to the appended drawings.

Figure 1:
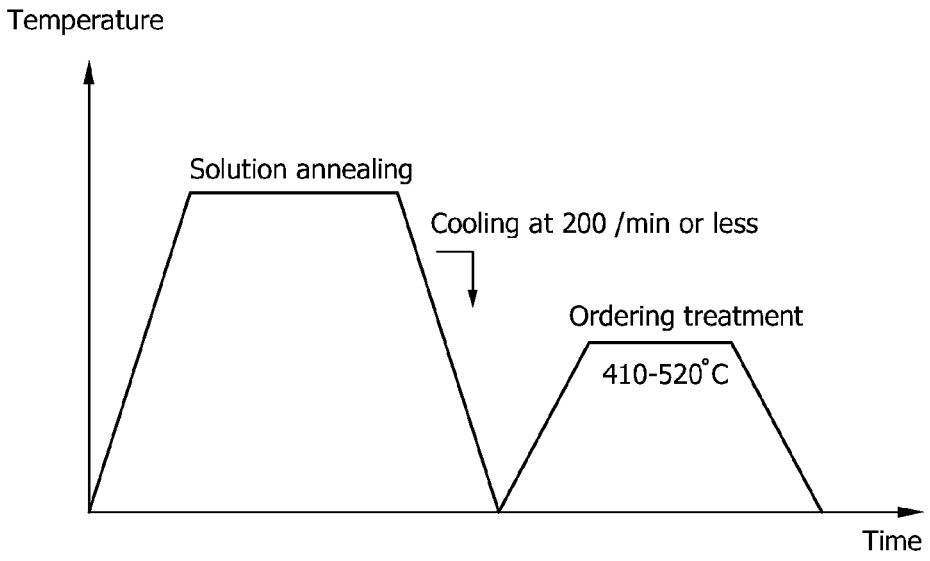
FIG. 1 is a drawing illustrating a method of manufacturing ordered Alloy 690 with improved thermal conductivity according to a first embodiment of the present invention.

FIG. 1 is a drawing illustrating a method of manufacturing ordered Alloy 690 with improved thermal conductivity according to a first embodiment of the present invention. Specifically, in the first embodiment of the present invention, there is illustrated a process in which Alloy 690 is solution-annealed, then cooled to less than an ordering temperature, and subjected to an ordering treatment. As shown in FIG. 1, ordered Alloy 690 according to the first embodiment of the present invention is manufactured by applying an ordering treatment to conventional Alloy 690 without thermal treatment (TT). In other words, the ordered Alloy 690 according to the present invention uses a process which applies 1) solution-annealing, 2) cooling to less than an ordering temperature, and 3) ordering treatment.

Specifically, in the manufacture of ordered Alloy 690 with improved thermal conductivity according to the first embodiment of the present invention, the solution-annealed Alloy 690 is cooled to less than an ordering temperature, heated to the ordering temperature, and then held there for an ordering treatment. In this case, a cooling rate is preferably 200° C./min or less.

Referring to FIG. 1, when a temperature is rapidly cooled from solution annealing temperature where carbides are fully dissolved to room temperature, formation of carbides can be inhibited, and thus it is necessary to lower a cooling rate to some extent. Therefore, in the first embodiment of the present invention, 1) solution-annealing, 2) cooling to less than an ordering temperature at a rate of 200° C./min or less, and 3) ordering treatment are preferably performed. In this case, in a process of cooling at a rate of 200° C./min or less from the solution-annealing temperature after solution annealing, it is preferable that a temperature be decreased as slowly as possible so that carbides can be precipitated at grain boundaries. This process has an effect of increasing an ordering rate by lowering the carbon content in solution. That is, precipitation of carbides decreases a concentration of carbon in solution in Alloy 690, leading to an increase in the ordering rate during both cooling and an additional ordering treatment.

Additionally, in the first embodiment of the present invention, in order to make an appropriate amount of carbides precipitated at grain boundaries of Alloy 690, ordered Alloy 690 with improved thermal conductivity is manufactured through solution-annealing (SA), slow cooling to induce precipitation of carbides at the grain boundary, and then ordering treatment. The term "ordered Alloy 690" used herein refers to a new alloy manufactured by performing solution-annealing and ordering treatment on Alloy 690 according to the present invention.

Figure 2:
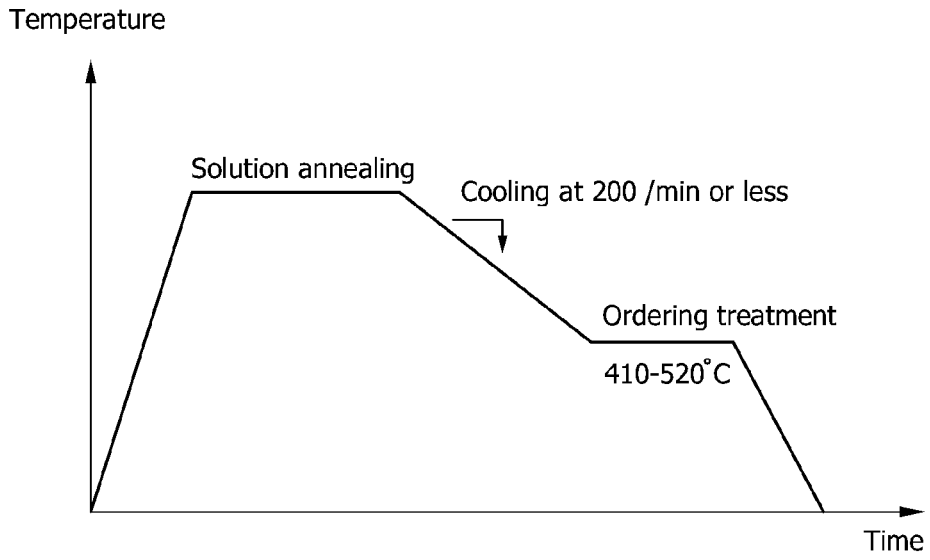
FIG. 2 is a drawing illustrating a method of manufacturing ordered Alloy 690 with improved thermal conductivity according to a second embodiment of the present invention.

FIG. 2 is a drawing illustrating a method of manufacturing ordered Alloy 690 with improved thermal conductivity according to a second embodiment of the present invention. Specifically, the second embodiment of the present invention includes 1) solution-annealing, 2) cooling to an ordering temperature at a rate of 200° C./min or less, and 3) ordering treatment after the cooling.

According to a second embodiment of the present invention, when Alloy 690 is solution-annealed and then not cooled to near room temperature, the following effects can be obtained.

After Alloy 690 is solution-annealed at a high temperature, although it varies depending on a cooling rate, it takes considerable time to cool the solution-annealed Alloy 690 to room temperature. In addition, when a natural cooling method is used, a cooling rate at a low temperature becomes lower, and thus the time required for cooling becomes longer. Therefore, when Alloy 690 is subjected to the ordering treatment on the way to cooling, the time and energy required for cooling and heating again for the ordering treatment may be saved. Thus, the ordering treatment on the way to cooling has an advantage in terms of manufacturing cost and time.

Figure 3:
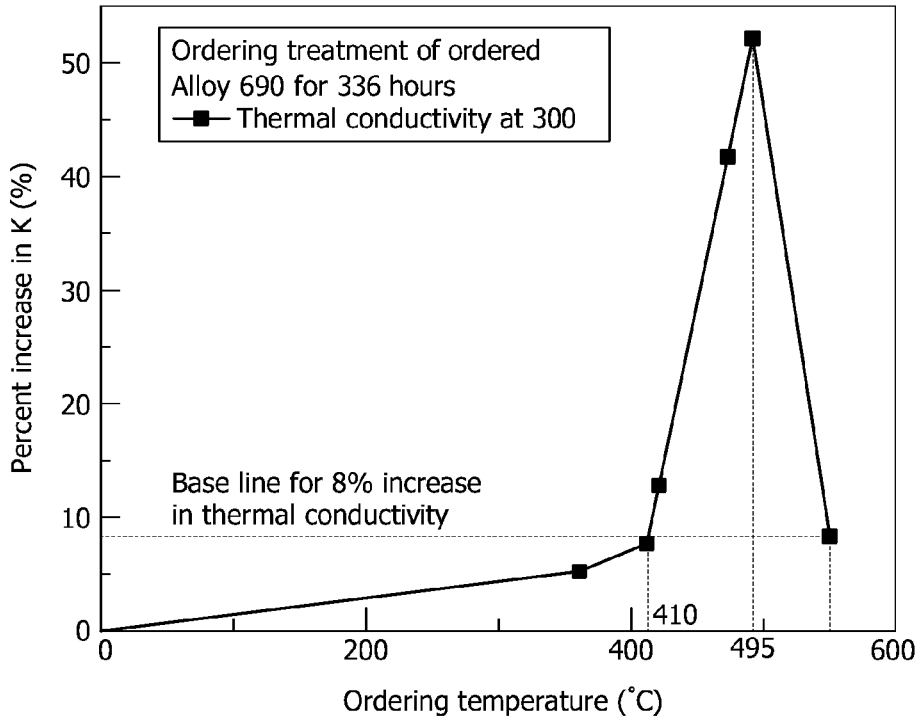
FIG. 3 is a graph illustrating a percent improvement in thermal conductivity at 300° C. of ordered Alloy 690 with isochronal ordering temperature ranging from 410° C. to 520° C. for 336 hours as compared to before the ordering treatment according to the present invention.

FIG. 3 is a graph illustrating a percent improvement in thermal conductivity at 300° C. of ordered Alloy 690 with isochronal ordering temperature ranging from 410 to 520° C. for 336 hours as compared to before the ordering treatment according to the present invention.

As shown in FIG. 3, when the ordering treatment is performed in a temperature range of 420-520° C., thermal conductivity of ordered Alloy 690 is increased by 8% or higher as compared to that before the ordering treatment. Here, the percent improvement in thermal conductivity is determined based on Alloy 690 which is solution-annealed and then water quenched. Also, the line indicated by a dotted line at 8% in FIG. 3 represents a desired target value of improved thermal conductivity according to the present invention. A minimum percent improvement in thermal conductivity is limited to 8% because an 8% variation in thermal conductivity is a reliable value in a 95% confidence interval in consideration of the standard deviation of a thermal conductivity value and the reliability of a measurement method.

An ordering temperature based on critical significance will now be described again with reference to FIG. 3. As shown in FIG. 3, when Alloy 690 is subjected to the ordering treatment in a temperature range of 410-495° C., the critical significance of the percent improvement in thermal conductivity compared to before the ordering treatment can be observed.

Specifically, as shown in FIG. 3, as an ordering temperature is increased, the percent improvement in thermal conductivity gradually increases, but is equal to or less than a desired value 8% until 410° C. However, there can be observed a sharp increase in the percent improvement in thermal conductivity caused by the ordering treatment at temperatures above 410° C. Such an increase in the percent improvement reaches its peak at 495° C., and rapidly decreases above 495° C.

Generally, it is well-known that thermal conductivity increases when a metal is thermally treated and the percent improvement in thermal conductivity is higher as a thermal treatment temperature is higher. According to the present invention, in the ordering treatment of the solution-annealed Alloy 690, the percent improvement in thermal conductivity is very small at a thermal treatment temperature of less than 410° C., sharply increases when an a thermal treatment temperature exceeds 410° C., and rapidly decreases at 495° C. or higher.

In conclusion, in the case of improving thermal conductivity of Alloy 690 through the ordering treatment, an ordering treatment in a temperature range of 410-495° C. can effectively obtain Alloy 690 with a high thermal conductivity, according to an exemplary embodiment of the present invention.

Figure 4:
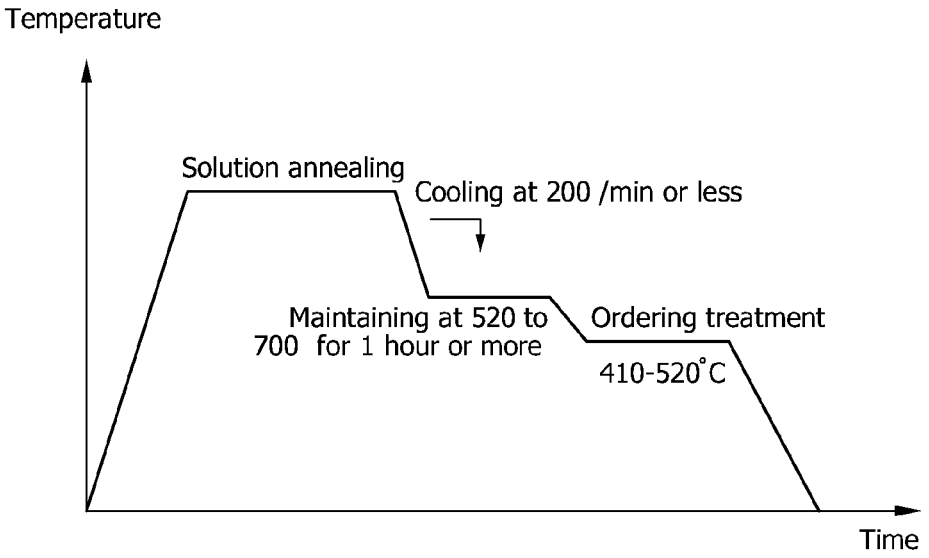
FIG. 4 is a drawing illustrating a method of manufacturing ordered Alloy 690 with improved thermal conductivity according to a third embodiment of the present invention.

FIG. 4 is a drawing illustrating a method of manufacturing ordered Alloy 690 with improved thermal conductivity according to a third embodiment of the present invention. Specifically, in the third embodiment of the present invention, there is illustrated a process of manufacturing ordered Alloy 690 with improved thermal conductivity, in which Alloy 690 is solution-annealed, then cooled at a rate of 200° C./min or less, maintained at 520-700° C. for 1 hour or more, consecutively cooled to an ordering temperature, and held there for an ordering treatment.

As shown in the third embodiment of the present invention, it is not necessary to perform the ordering treatment at a constant temperature, and an ordering effect can be obtained even by maintaining the ordering treatment temperature within a predetermined range.

In the third embodiment of the present invention, the maintenance at 520-700° C. for 1 hour or more before the ordering treatment is included. Accordingly, a sufficient amount of carbides is s precipitated by heat treating at 520-700° C. for 1 hour or more in the cooling process after solution-annealing, leading to a decrease in the carbon content in solution. Conventionally, a thermal treatment (TT) at 700-750° C. is performed to precipitate carbides, and thus when carbides are precipitated, the carbon content in solution is decreased and an ordering rate in a cooling process become enhanced. However, in the third embodiment of the present invention, an ordering rate in a cooling process is increased by heat treatment at 700° C. or less for 1 hour or more, unlike a conventional TT. Therefore, an ordering rate in the subsequent ordering treatment may be more increased than in the second embodiment of the present invention in which Alloy 690 is solution-annealed and then cooled at a rate of 200° C./min or less.

However, heat treatment at 520-700° C. for 1 hour or more according to the present invention is not limited to only the third embodiment of the present invention. In other words, heat treatment may be performed at 520-700° C. for 1 hour or more in the cooling to less than an ordering temperature as shown in FIG. 1 as well as in the cooling to an ordering temperature after solution-annealing. In this case, of the carbon content in solution can also be sufficiently decreased due to precipitation of carbides.

Figure 5:
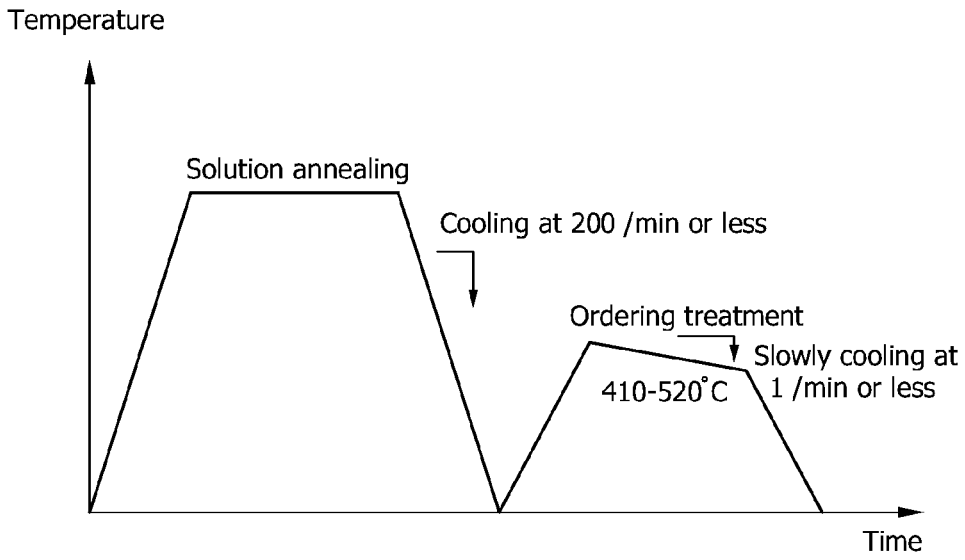
FIG. 5 is a drawing illustrating a method of manufacturing ordered Alloy 690 with improved thermal conductivity according to a fourth embodiment of the present invention.

FIG. 5 is a drawing illustrating a method of manufacturing ordered Alloy 690 with improved thermal conductivity according to a fourth embodiment of the present invention. Specifically, in the fourth embodiment of the present invention, there is illustrated a process of manufacturing ordered Alloy 690 with improved thermal conductivity, in which Alloy 690 is solution-annealed, then cooled to less than an ordering temperature at a rate of 200° C./min or less, and subjected to an ordering treatment once or more by way of slowly decreasing the ordering temperature during the ordering treatment. As shown in the fourth embodiment of the present invention, it is not necessary to perform the ordering treatment at a constant temperature, and an ordering effect can be obtained even when an ordering temperature is maintained within a predetermined range.

Figure 6:
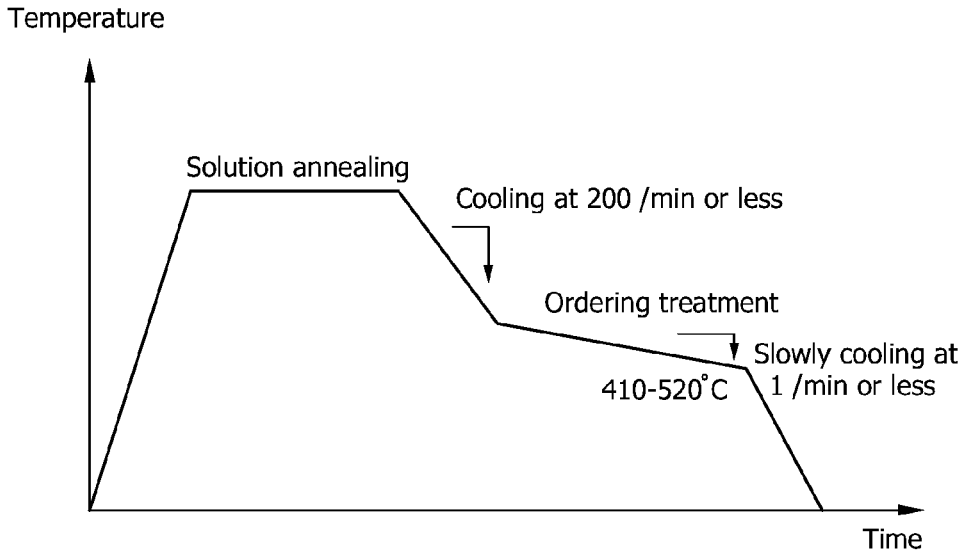
FIG. 6 is a drawing illustrating a method of manufacturing ordered Alloy 690 with improved thermal conductivity according to a fifth embodiment of the present invention.

FIG. 6 is a drawing illustrating a method of manufacturing ordered Alloy 690 with improved thermal conductivity according to a fifth embodiment of the present invention. Specifically, in the fifth embodiment of the present invention, there is illustrated a process of manufacturing ordered Alloy 690 with improved thermal conductivity, in which Alloy 690 is solution-annealed, then consecutively cooled to an ordering temperature at a rate of 200° C./min or less, and subjected to an ordering treatment one or more times by way of slowly decreasing the ordering temperature during the ordering treatment. In the fifth embodiment of the present invention, unlike FIG. 5, it is not necessary to cool to less than an ordering temperature, and thus the manufacturing time can be saved.

Figure 7:
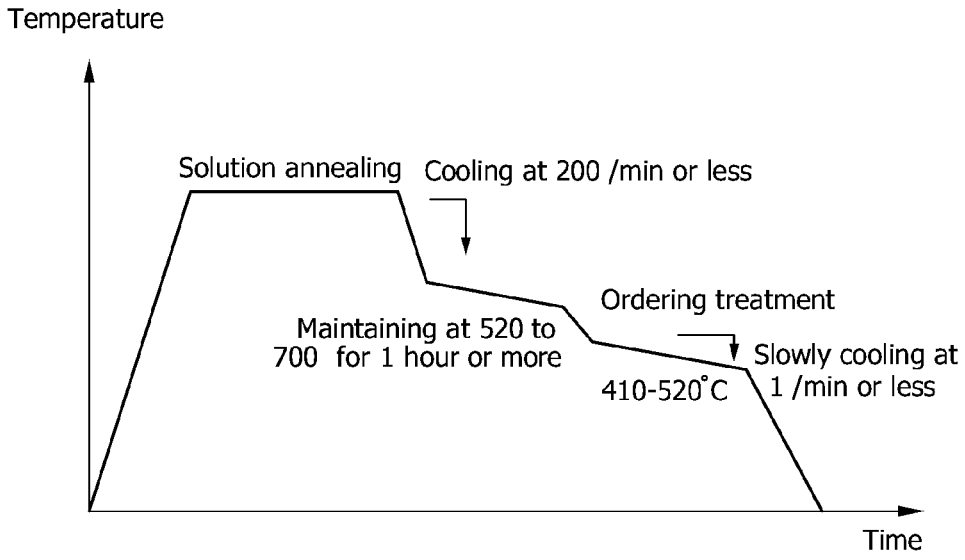
FIG. 7 is a drawing illustrating a method of manufacturing ordered Alloy 690 with improved thermal conductivity according to a sixth embodiment of the present invention.

FIG. 7 is a drawing illustrating a method of manufacturing ordered Alloy 690 with improved thermal conductivity according to a sixth embodiment of the present invention. Specifically, in the sixth embodiment of the present invention, there is illustrated a process of manufacturing ordered Alloy 690 with improved thermal conductivity, in which Alloy 690 is solution-annealed, then cooled at a rate of 200° C./min or less, maintained at 520-700° C. for 1 hour or more, consecutively cooled to an ordering temperature, and subjected to an ordering treatment one or more times by way of slowly decreasing the ordering temperature during the ordering treatment. The sixth embodiment of the present invention is similar to the fourth and fifth embodiments in terms of technology, but an ordering rate can be increased by reducing the carbon content in solution, as described above.

Figure 8:
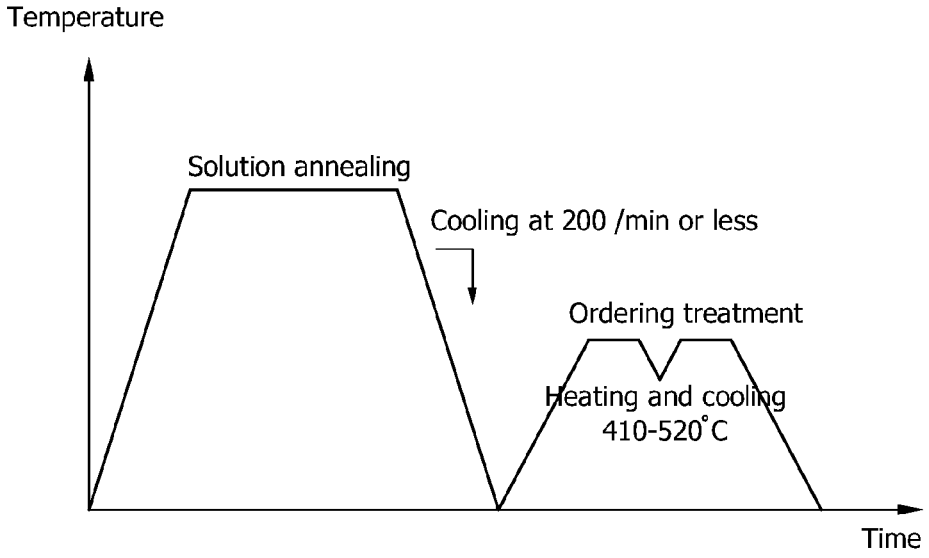
FIG. 8 is a drawing illustrating a method of manufacturing ordered Alloy 690 with improved thermal conductivity according to a seventh embodiment of the present invention.

FIG. 8 is a drawing illustrating a method of manufacturing ordered Alloy 690 with improved thermal conductivity according to a seventh embodiment of the present invention. Specifically, in the seventh embodiment of the present invention, there is illustrated a process of manufacturing ordered Alloy 690 with improved thermal conductivity, in which Alloy 690 is solution-annealed, then cooled to less than an ordering temperature at a rate of 200° C./min or less, heated to the ordering temperature and held there for an ordering treatment in which a process of heating and cooling is repeated. In the seventh embodiment of the present invention, since an ordering effect is not necessarily exhibited only at a certain temperature as described above, an ordering effect can be obtained even when a process of heating and cooling is performed within an ordering temperature range.

Figure 9:
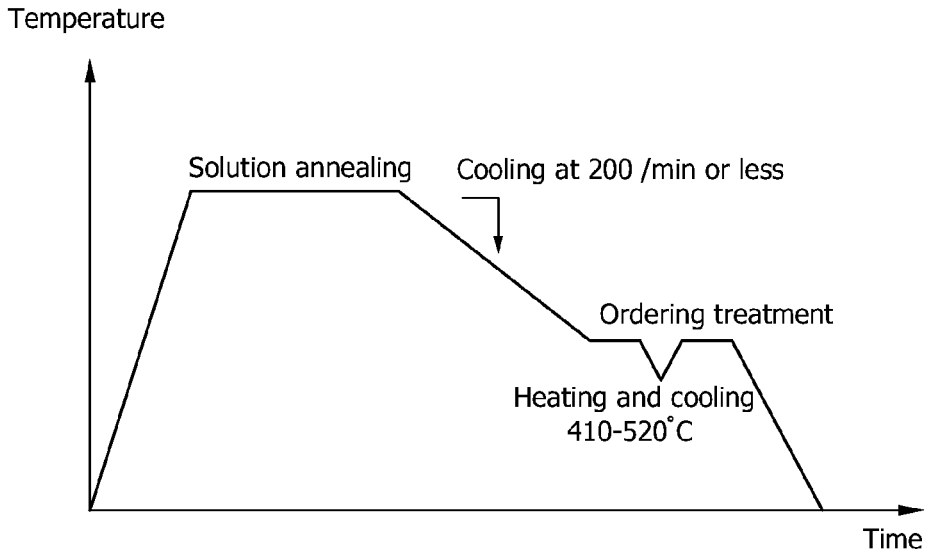
FIG. 9 is a drawing illustrating a method of manufacturing ordered Alloy 690 with improved thermal conductivity according to an eighth embodiment of the present invention.

FIG. 9 is a drawing illustrating a method of manufacturing ordered Alloy 690 with improved thermal conductivity according to an eighth embodiment of the present invention. Specifically, in the eighth embodiment of the present invention, there is illustrated a process of manufacturing ordered Alloy 690 with improved thermal conductivity, in which Alloy 690 is solution-annealed, cooled to an ordering temperature at a rate of 200° C./min or less, and then consecutively subjected to an ordering treatment in which a process of heating and cooling is repeated.

Figure 10:
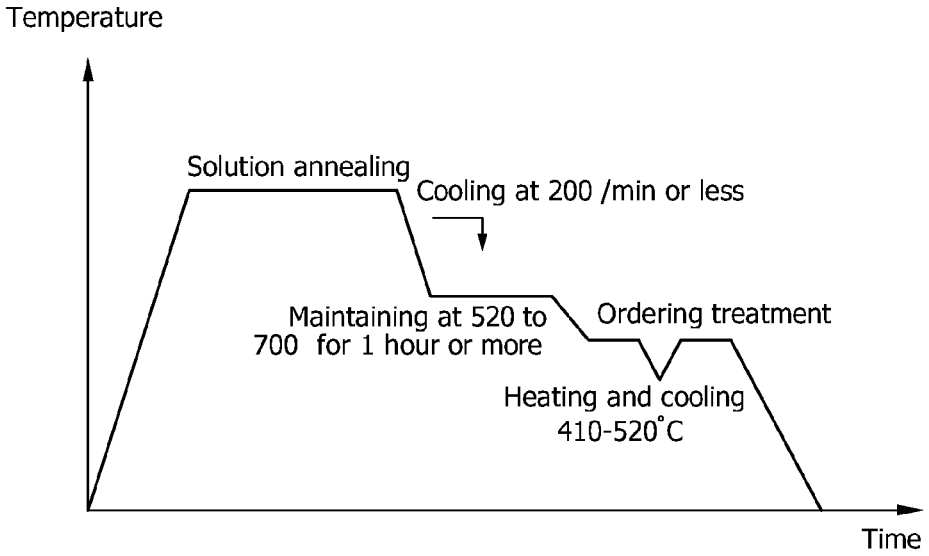
FIG. 10 is a drawing illustrating a method of manufacturing ordered Alloy 690 with improved thermal conductivity according to a ninth embodiment of the present invention.

FIG. 10 is a drawing illustrating a method of manufacturing ordered Alloy 690 with improved thermal conductivity according to a ninth embodiment of the present invention. Specifically, in the ninth embodiment of the present invention, there is illustrated a process of manufacturing ordered Alloy 690 with improved thermal conductivity, in which Alloy 690 is solution-annealed, cooled at a rate of 200° C./min or less, maintained at 520-700° C. for 1 hour or more, then consecutively cooled to an ordering temperature, and subjected to an ordering treatment in which a process of heating and cooling is repeated.

Figure 11:
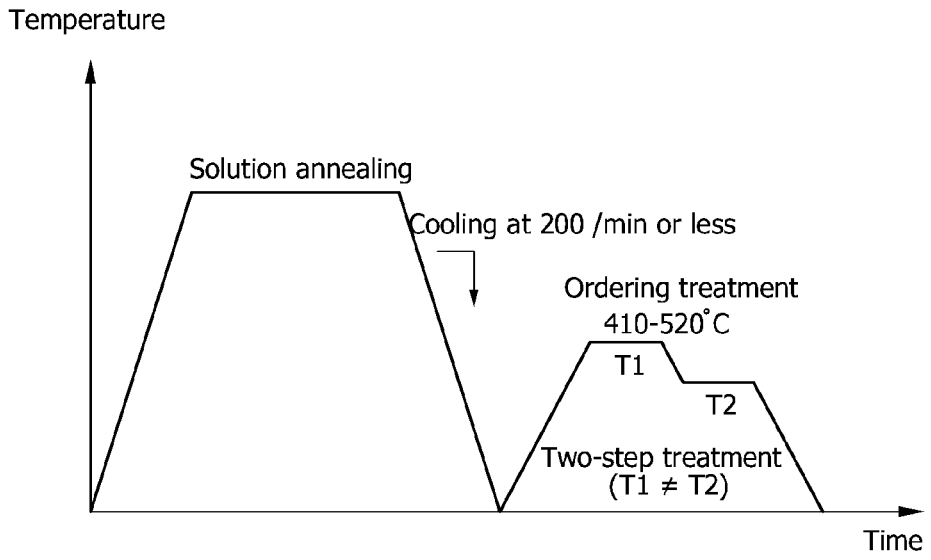
FIG. 11 is a drawing illustrating a method of manufacturing ordered Alloy 690 with improved thermal conductivity according to a tenth embodiment of the present invention.

FIG. 11 is a drawing illustrating a method of manufacturing ordered Alloy 690 with improved thermal conductivity according to a tenth embodiment of the present invention. Specifically, in the tenth embodiment of the present invention, there is illustrated a process of manufacturing ordered Alloy 690 with improved thermal conductivity, in which Alloy 690 is solution-annealed, cooled to less than an ordering temperature at a rate of 200° C./min or less, heated again, and held there for an ordering treatment which is performed at two different temperatures (T1≠T2).

Figure 12:
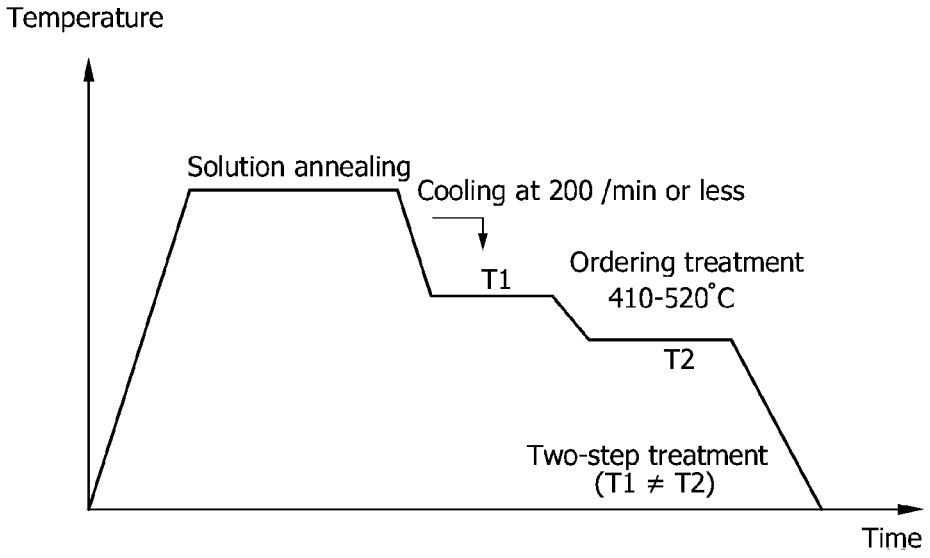
FIG. 12 is a drawing illustrating a method of manufacturing ordered Alloy 690 with improved thermal conductivity according to an eleventh embodiment of the present invention.

FIG. 12 is a drawing illustrating a method of manufacturing ordered Alloy 690 with improved thermal conductivity according to an eleventh embodiment of the present invention. Specifically, in the eleventh embodiment of the present invention, there is illustrated a process of manufacturing ordered Alloy 690 with improved thermal conductivity, in which Alloy 690 is solution-annealed, cooled to less than an ordering temperature at a rate of 200° C./min or less, and consecutively subjected to an ordering treatment which is performed at two different temperatures (T1≠T2).

Figure 13:
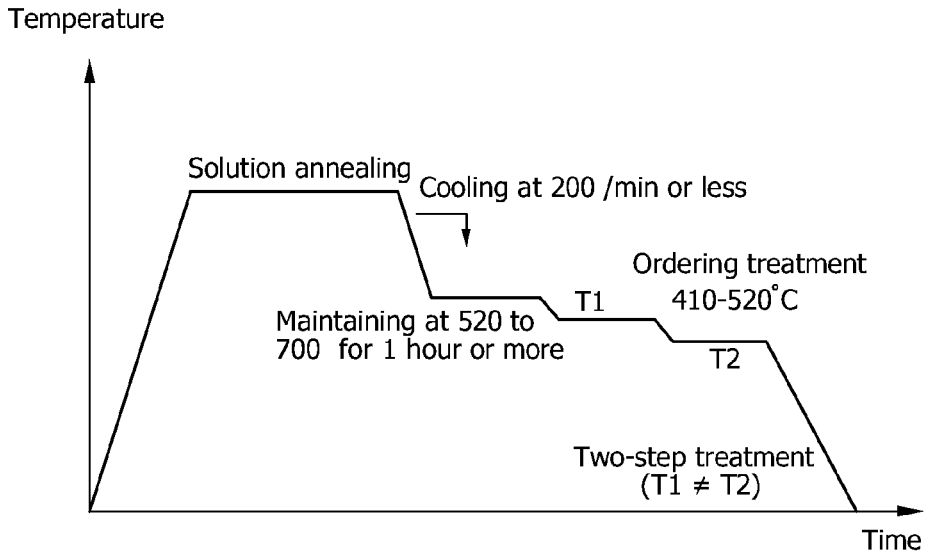
FIG. 13 is a drawing illustrating a method of manufacturing ordered Alloy 690 with improved thermal conductivity according to a twelfth embodiment of the present invention.

FIG. 13 is a drawing illustrating a method of manufacturing ordered Alloy 690 with improved thermal conductivity according to a twelfth embodiment of the present invention. Specifically, in the twelfth embodiment of the present invention, there is illustrated a process of manufacturing ordered Alloy 690 with improved thermal conductivity, in which Alloy 690 is solution-annealed, cooled at a rate of 200° C./min or less, maintained at 520-700° C. for 1 hour or more, then consecutively cooled to an ordering temperature, and subjected to an ordering treatment which is performed at two different temperatures (T1≠T2).

Figure 14:
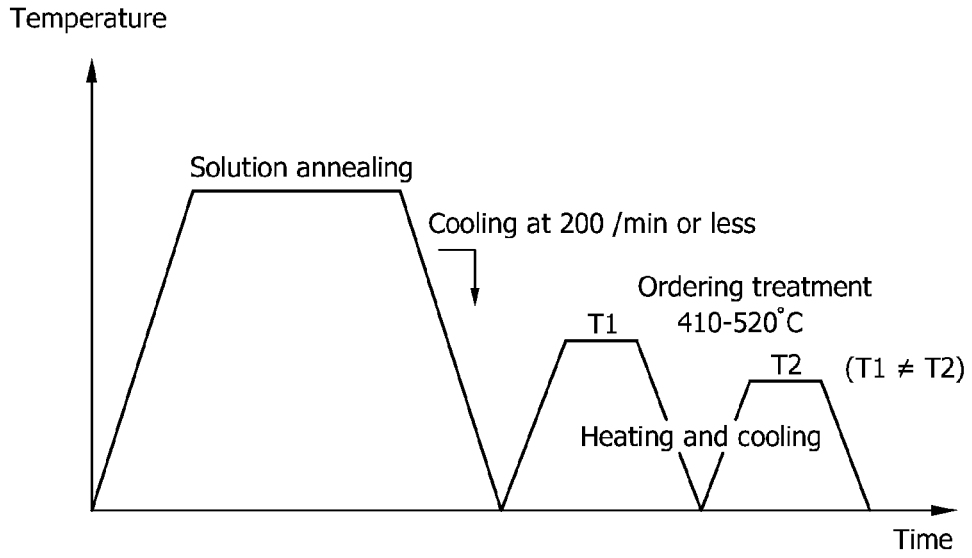
FIG. 14 is a drawing illustrating a method of manufacturing ordered Alloy 690 with improved thermal conductivity according to a thirteenth embodiment of the present invention.

FIG. 14 is a drawing illustrating a method of manufacturing ordered Alloy 690 with improved thermal conductivity according to a thirteenth embodiment of the present invention. Specifically, in the thirteenth embodiment of the present invention, there is illustrated a process of manufacturing ordered Alloy 690 with improved thermal conductivity, in which Alloy 690 is solution-annealed, cooled to less than an ordering temperature at a rate of 200° C./min or less, heated to the ordering temperature, and held there for an ordering treatment in which a process of heating and cooling is repeated one or more times within an ordering temperature range such that the ordering treatment is performed at two different temperatures (T1≠T2).

Figure 15:
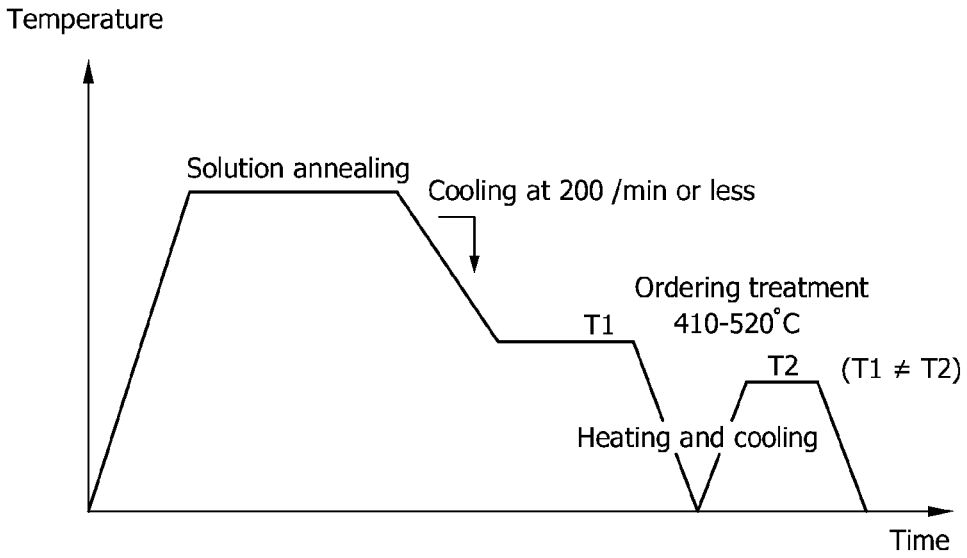
FIG. 15 is a drawing illustrating a method of manufacturing ordered Alloy 690 with improved thermal conductivity according to a fourteenth embodiment of the present invention.

FIG. 15 is a drawing illustrating a method of manufacturing ordered Alloy 690 with improved thermal conductivity according to a fourteenth embodiment of the present invention. Specifically, in the fourteenth embodiment of the present invention, there is illustrated a process of manufacturing ordered Alloy 690 with improved thermal conductivity, in which Alloy 690 is solution-annealed, cooled to an ordering temperature at a rate of 200° C./min or less, and consecutively subjected to an ordering treatment in which a process of heating and cooling is repeated one or more times within an ordering temperature range such that the ordering treatment is performed at two different temperatures (T1≠T2).

Figure 16:
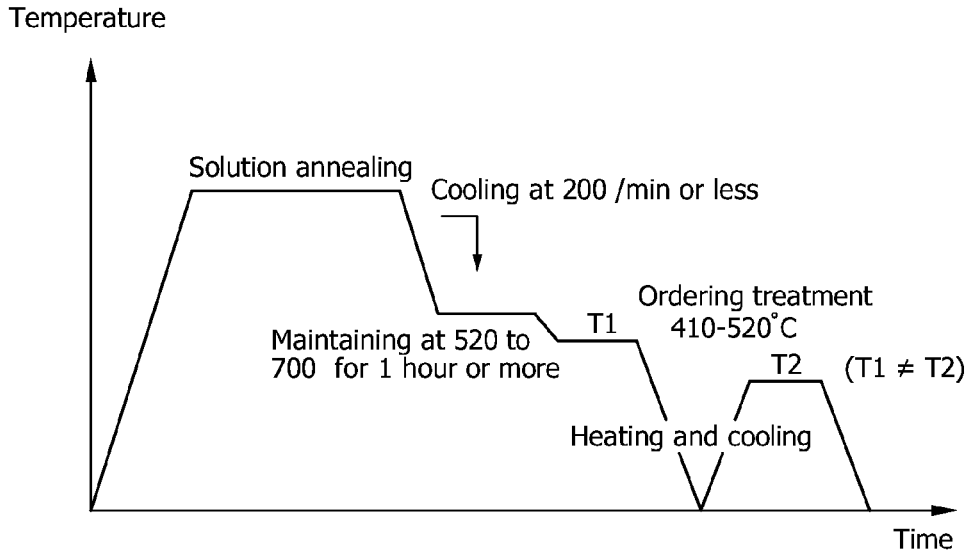
FIG. 16 is a drawing illustrating a method of manufacturing ordered Alloy 690 with improved thermal conductivity according to a fifteenth embodiment of the present invention.

FIG. 16 is a drawing illustrating a method of manufacturing ordered Alloy 690 with improved thermal conductivity according to a fifteenth embodiment of the present invention. Specifically, in the fifteenth embodiment of the present invention, there is illustrated a process of manufacturing ordered Alloy 690 with improved thermal conductivity, in which Alloy 690 is solution-annealed, cooled at a rate of 200° C./min or less, maintained at 520-700° C. for 1 hour or more, then cooled to an ordering temperature, and consecutively subjected to an ordering treatment in which a process of heating and cooling is repeated one or more times within an ordering temperature range such that the ordering treatment is performed at two different temperatures (T1≠T2).

While the present invention has been particularly described with reference to exemplary embodiments, it will be understood by those of skilled in the art that various changes in form and details may be made without departing from the spirit and scope of the present invention. Therefore, the exemplary embodiments should be considered in a descriptive sense only and not for purposes of limitation. The scope of the invention is defined not by the detailed description of the invention but by the appended claims, and encompasses all modifications and equivalents that fall within the scope of the appended claims.

The invention claimed is:

1. A method of manufacturing ordered Alloy 690, the method comprising:

solution-annealing Alloy 690;

cooling the solution-annealed Alloy 690 to a first temperature at a cooling rate of 200° C./min or less; and ordering the cooled Alloy 690 by annealing at a temperature ranging from 410 to 520° C., which provides the ordered Alloy 690 that has a thermal conductivity rate higher than that of the cooled Alloy 690 by at least 8%;

wherein the first temperature is equal to or less than the ordering temperature and equal to or greater than room temperature.

2. The method according to claim 1, wherein the first temperature is the ordering temperature and the ordering treatment is performed after the cooling.

3. The method according to claim 1, wherein the ordering treatment is performed on the solution-annealed Alloy 690 which is maintained at a temperature ranging from 520 to 700° C. for 1 hour or more during the cooling.

4. The method according to claim 2, wherein the ordering treatment is performed on the solution-annealed Alloy 690 which is maintained at a temperature ranging from 520 to 700° C. for 1 hour or more during the cooling.

5. The method according to claim 1, wherein the ordering treatment includes the cooling at a rate of 1° C./min or less.

6. The method according to claim 1, wherein the ordering treatment includes repeating a process of heating and cooling once or more within a range of the ordering temperature.

7. The method according to claim 1, wherein the ordering treatment is performed at two different temperatures within a range of the ordering temperature.

8. The method according to claim 1, wherein the ordering treatment is performed by repeating a process of heating and cooling once or more at two different temperatures within a range of the ordering temperature.

* * * * *